US008523374B2

(12) United States Patent
Pae

(10) Patent No.: US 8,523,374 B2
(45) Date of Patent: Sep. 3, 2013

(54) REFRIGERATOR AND DOOR THEREOF

(75) Inventor: Chanju Pae, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 12/918,110

(22) PCT Filed: Dec. 17, 2008

(86) PCT No.: PCT/KR2008/007497

§ 371 (c)(1),
(2), (4) Date: Aug. 18, 2010

(87) PCT Pub. No.: WO2009/104858

PCT Pub. Date: Aug. 27, 2009

(65) Prior Publication Data

US 2010/0313592 A1 Dec. 16, 2010

(30) Foreign Application Priority Data

Feb. 21, 2008 (KR) ..... 10-2008-0015780

(51) Int. Cl.
*F25D 27/00* (2006.01)
*F25D 23/02* (2006.01)

(52) U.S. Cl.
USPC ..... 362/92; 62/264; 62/449; 62/444

(58) Field of Classification Search
USPC ..... 362/92; 62/264, 125–126, 129, 62/444, 449
See application file for complete search history.

(56) References Cited

U.S. PATENT DOCUMENTS

| | | | | |
|---|---|---|---|---|
| 2006/0075696 | A1* | 4/2006 | Alessandro | 52/171.1 |
| 2007/0157638 | A1* | 7/2007 | Wetekamp | 62/126 |
| 2008/0244869 | A1* | 10/2008 | Bae et al. | 16/412 |
| 2010/0319383 | A1* | 12/2010 | Kim | 62/264 |

FOREIGN PATENT DOCUMENTS

| | | | |
|---|---|---|---|
| KR | 10-2004-0045939 | A | 6/2004 |
| KR | 10-2006-0013202 | A | 2/2006 |
| KR | 10-2007-0069665 | A | 7/2007 |

OTHER PUBLICATIONS

International Search Report dated Apr. 21, 2009 for Application No. PCT/KR2008/007497, 2 pages.

* cited by examiner

*Primary Examiner* — Karabi Guharay
(74) *Attorney, Agent, or Firm* — Fish & Richardson P.C.

(57) ABSTRACT

This present embodiment relates to a refrigerator. The refrigerator includes an exterior member which defines the appearance of the refrigerator and in which a transmissive part, through which light is passed, is formed; a decoration member provided at a rear side of the exterior member; and a light-emitting unit which emits light toward the decoration member.

20 Claims, 4 Drawing Sheets

REFRIGERATOR AND DOOR THEREOF

TECHNICAL FIELD

This document relates to a refrigerator and a door thereof.

BACKGROUND ART

Generally, a refrigerator is a device that allows foods to be stored at a low temperature.

The refrigerator includes a main body in which a storage chamber is formed, and a door which opens or closes the storage chamber as it is connected to the main body. And, an exterior member which defines the appearance thereof to improve an aesthetic stylish appearance may be provided in the door or main body.

DISCLOSURE OF INVENTION

Technical Problem

An object of the present embodiment is to propose a refrigerator which improves an aesthetic appearance as light is emitted therefrom by a light-emitting unit.

Technical Solution

According to an aspect of the present embodiment, there is provided a refrigerator including an exterior member which partially defines the appearance of the refrigerator and has a transmissive part through which light is passed; a decoration member provided at one side of the exterior member; and a light-emitting unit which emits lights, wherein at least some of the light emitted therefrom passes through the transmissive part.

According to another aspect of the present embodiment, there is provided a refrigerator including a refrigerator main body in which a storage chamber is formed; and a door for opening/closing the storage chamber, wherein the door includes a door main body, an exterior member provided ahead of the door main body, a decoration member provided at the rear of the exterior member, and a light-emitting unit for emitting light so that the decoration member can be easily recognized from the outside.

According to further another aspect of the present embodiment, there is provided a refrigerator including a refrigerator main body in which a storage chamber is formed; and a door for opening/closing the storage chamber; an exterior member provided at an outer side of the refrigerator main body and in which a transmissive part for transmitting light is formed; a decoration member provided at the rear of the exterior member; and a light-emitting unit for emitting light to the decoration member, wherein at least some of the light emitted from the light-emitting unit passes through the transmissive part.

Advantageous Effects

According to the embodiments described above, there is an advantage in that an aesthetic appearance of a refrigerator is improved, since light emitted from a light-emitting unit emits to the outside after passing through a decoration member.

Also, there is an advantage in that users may recognize patterns expressed on the exterior member, even though, in a dark state where luminous intensity is low.

Furthermore, there is an advantage in that users may easily recognize positions of the refrigerator and handle in a dark state because of the light emitted from the light-emitting unit. That is, the light-emitting unit may serve as an indoor light.

BRIEF DESCRIPTION OF THE DRAWINGS

FIG. 5 is a front view showing a state where a light-emitting unit according to the first embodiment is turned-on.

MODE FOR THE INVENTION

Hereinafter, preferred embodiments of the present invention will be explained in detail with reference to the accompanying drawings.

Figure 1:
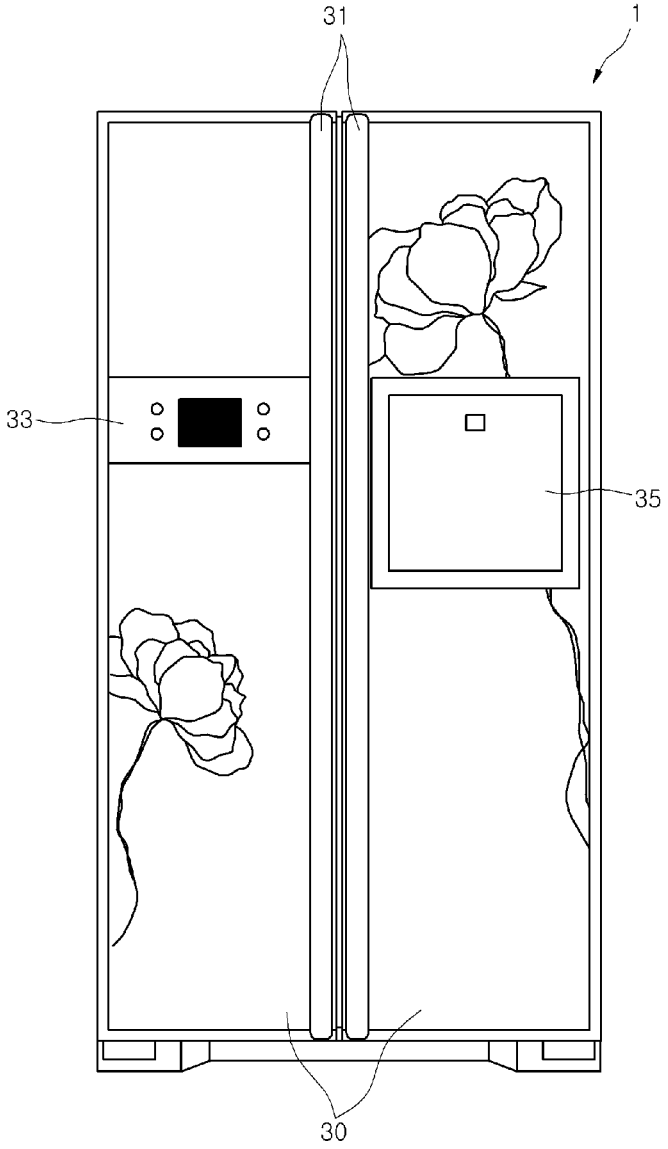
FIG. 1 is a front view of a refrigerator according to a first embodiment.

FIG. 1 shows a refrigerator according to a first embodiment in a front view.

Even though a side by side type refrigerator in which a refrigerating chamber and a freezing chamber are horizontally arranged side-by-side is illustrated in FIG. 1, however the scope of the present invention is not restricted thereto, it should be noted that the present invention may be applied to a top mount type refrigerator in which a freezing chamber is disposed above a refrigerating chamber and to a bottom freezer type refrigerator in which a freezing chamber is disposed below a refrigerating chamber.

Furthermore, the scope of the present invention may be applied to a refrigerator in which only one of a freezing chamber and a refrigerating chamber is formed.

Referring to FIG. 1, a refrigerator 1 of the present invention includes a main body 10 having at least one storage chamber, and a door 30 for opening/closing the storage chamber. The door 30 is movably, for example rotatably, connected to the main body 10, and it defines at least some of the appearance of the refrigerator 1.

The door 30 may be provided with a handle 31 for allowing users to grasp it, a display assembly 33 for showing operational state of the refrigerator, and a home bar 35 for easily taking out foodstuffs in the storage chamber, and a dispenser (not shown) for dispensing water or ice.

Meanwhile, a front surface of the door 30 is configured to have an aesthetic appearance because various colors and patterns are embodied thereon, and is configured to emit light of a light-emitting unit (see reference numeral 800 in FIG. 3) to the outside of the door 30 via the patterns formed on the front surface of the door 30 when operating the light-emitting unit (see reference numeral 800 in FIG. 3), which will be mentioned later.

Figure 2:
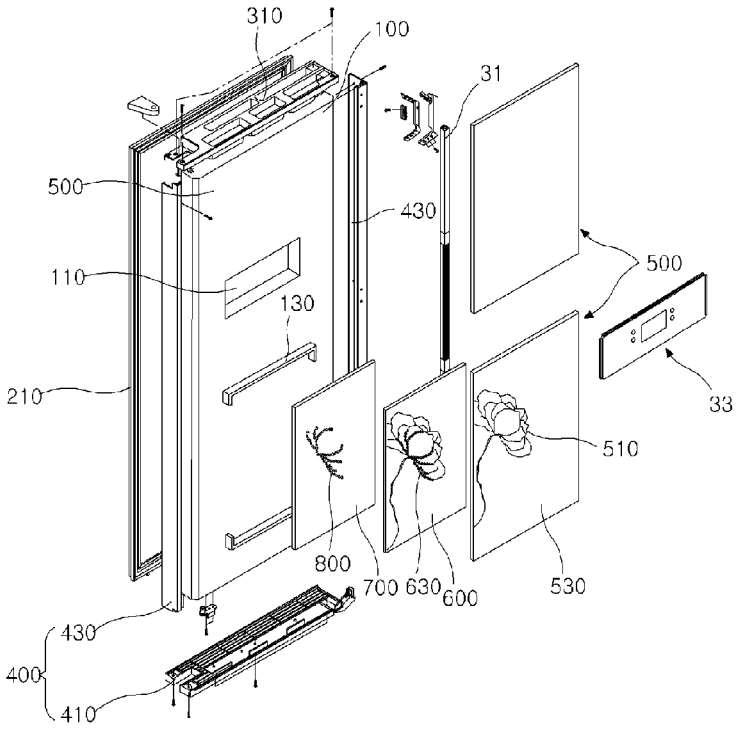
FIG. 2 is an exploded perspective view of a refrigerator door according to the first embodiment.
Figure 3:
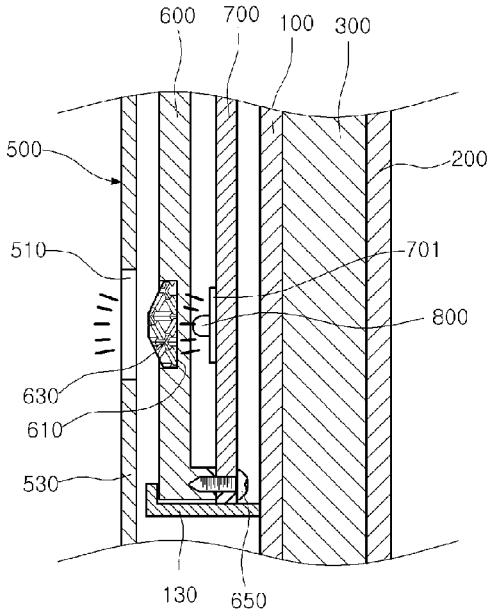
FIG. 3 is a cross-section view of the refrigerator door according to the first embodiment.

FIG. 2 shows a refrigerator door according to the first embodiment in an exploded perspective view, and FIG. 3 shows the refrigerator door according to the first embodiment in a cross-section view.

Referring to FIGS. 2 and 3, the door 30 includes a door main body.

The door main body includes an outer case 100, an inner case 200, and a thermal insulator 300 interposed between the outer and inner cases 100, 200.

The outer case 100 may be formed of, for example, metallic material. In a front surface of the outer case 100, a display mounting portion 110 for accommodating the display assembly 33 is depressed and formed.

The inner case 200 may be formed of, for example, plastic material.

In case the outer case 100 and inner case 200 are connected to each other, a space in which the thermal insulator 300 is to be filled is formed between the outer and inner cases 100, 200. The thermal insulator 300 may be formed of, for example, a foaming material such as expandable poly-styrene (EPS).

After the thermal insulator 300 has been foamed and filled, a decoration member 400 and an exterior member 500 are connected to the door main body.

The decoration member 400 serves to connect the exterior member 500 to the door main body, and it defines edges of the door.

In detail, the decoration member 400 includes a cap deco 410 provided at upper/lower parts of the door main body, and a side deco 430 provided at left/right sides of the door main body.

The exterior member 500 defines a front appearance of the door 30. The exterior member 500 may include one plate or a plurality of plates.

The exterior member 500 is formed of tempered glass or plastic material which is transparent to light. Various colors may printed on front or rear surfaces of the exterior member 500, and various patterns, for example such as a floral shape, may be printed thereon.

Patterns expressed on the exterior member 500 are formed by a transmissive part 510. The transmissive part 510 serves to transmit light emitted from the light-emitting unit 800 and is transparently or semi-transparently formed. On the other hand, the transmissive part 510 may be a hole.

Other parts, except the transmissive part 510, of the exterior member 500 may be opaquely formed, or they may be printed with various colors after being transparently or semi-transparently formed. Therefore, light generated by the light-emitting unit 800 may not pass through the other parts, except the transmissive part 510, of the exterior member 500 to the outside.

That is, the exterior member 500 may includes an anti-transmissive part 530 through which light cannot pass, and a transmissive part 510 through which light can pass.

A light-transparent colored sheet may be attached to the transmissive part 510 such that the amount and color of the light passing through can be controlled. Also, the transmissive part 510 may be printed such that the amount and color of the light passing through can be controlled.

Also, a transparent plate 600 is provided at a rear of the exterior member 500. A plurality of decorative parts 630, for example jewels, are mounted on the transparent plate 600. The transparent plate 600 may be formed of, for example, transparent materials such as transparent acryl.

A plurality of accommodating portions 610 for receiving the decorative parts 630 are formed in the transparent plate 600. The accommodating portions 610 may be grooves or holes.

The plurality of accommodating portions 610 may be formed correspondingly to the shape of the transmissive part 510, or some of them may be formed correspondingly to the shape of the transmissive part 510. That is, at least part of the shape of the plurality of accommodating portions 610 corresponds to the shape of the plurality of transmissive parts 510.

And, colors different from colors of the anti-transmissive part may be printed on the accommodating portion 610.

The decorative part 630, mounted on the accommodating portion 610, is formed of light transparent materials such as glass, crystal and cubic.

Meanwhile, a fixed plate 700 provided at a rear side of the transparent plate 600. A plurality of light-emitting units 800 are installed at the fixed plate 700. The light-emitting units 800 may be, for example, LEDs, and the fixed plate 700 may be a printed circuit board on which a plurality of LEDs are mounted. Unlike this case, the light-emitting units 800 may be lamps, and it should be noted that any structure for emitting light can be used.

The fixed plate 700 may be fixed to the transparent plate 600 by a connection member 650, in a state that a part 701 in which the light-emitting unit 800 is installed is spaced apart from the transparent plate 600.

Therefore, the transparent plate 600 and fixed plate 700, in a state that the decorative part 630 and light-emitting units 800 are installed therein, may be constituted as an assembly.

Further, the transparent plate 600 and fixed plate 700 may be fixed to the outer case 100. In detail, a mounting portion 130, in which the transparent plate 600 and fixed plate 700 are to be installed, is formed at a front surface of the outer case 100.

The mounting portion 130 supports at least one edge of the transparent plate 600 and fixed plate 700.

Meanwhile, the plurality of light-emitting units 800 are positioned correspondingly to the plurality of decorative parts 630 such that light emitted from the light-emitting units 800 can pass through the decorative parts 630.

And, the number of the plurality of light-emitting units 800 may be the same as the number of the plurality of decorative parts.

And, as shown in FIG. 3, the light-emitting unit 800, decorative part 630 and transmissive part 510 may be positioned on the same line, and therefore light emitted from the light-emitting unit 800 may be emitted out of the door 30 via the decorative part 630 and transmissive part 510.

Meanwhile, a gasket 210 is provided around the periphery of a rear surface of the inner case 200. The gasket 210 is to seal a space between the door 30 and the storage chamber, and is made of a material having elasticity.

And, a power line for supplying electric power into the light-emitting unit 800 may be disposed along a hinge for ratating the door 30 around the main body 10.

According to the present embodiment, the light-emitting unit 800 is installed at the fixed plate 700, however the light-emitting unit 800 may also be installed at the outer case 100.

Figure 4:
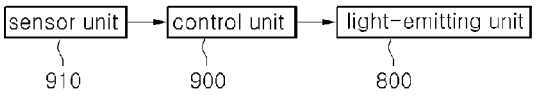
FIG. 4 is a block diagram showing a control structure of the refrigerator according to the first embodiment.
Figure 5:
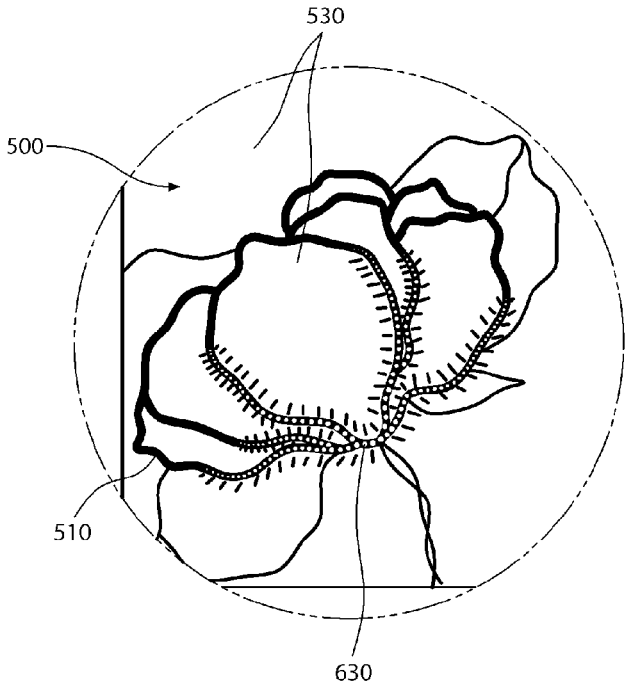

FIG. 4 shows a control structure of the refrigerator according to the first embodiment in a block diagram, and FIG. 5 shows a state where a light-emitting unit according to the first embodiment is turned-on in a front view.

Referring to FIGS. 1 to 5, the refrigerator 1 includes a control unit 900 for controlling the operation of the light-emitting unit, and a sensor unit 910 for detecting the intensity of illumination at the site where the refrigerator 1 is installed.

The control unit 900 may control the operation of the whole refrigerator, or the control unit 900 may be provided separately from a main control unit for controlling the operation of the main body of the refrigerator 1.

Meanwhile, in case the intensity of illumination at the site where the refrigerator 1 is installed is higher than a standard value, the light-emitting unit 800 maintains the off state. In this state, users can recognize the patterns expressed on the exterior member 500 from the outside of the door 30 without operating the light-emitting unit 800.

However, in case the intensity of illumination at the site where the refrigerator 1 is installed is lower than the standard value, it is hard for the users to recognize the patterns expressed on the exterior member 500. Accordingly, in case the intensity of illumination at the site is lower than the standard value, the light-emitting unit 800 is turned on.

After that, light is emitted from the light-emitting unit 800. And, the emitted light passes through the decorative part 630 and transmissive part 510 to the outside of the door 30. Accordingly, the light-emitting unit serves as a light since users may recognize the light emitted from the door, thereby improving the aesthetic appearance of the door. Here, the intensity of the light emitted from the light-emitting unit 800 may be changed with respect to the intensity of illumination, which is detected by the sensor unit 910.

Meanwhile, in order to emphasize the patterns expressed on the exterior member 500, the decorative parts 630 may be localized into a specific site or may be arranged on a specific line, and the light-emitting unit 800 may also be concentrated or continually arranged according to the arrangement of the decorative part 630.

And, in order to control the transmissivity of light, semi-transparent paints may be applied to the transmissive part 510 or semi-transparent sheets may be attached thereto.

Figure 6:
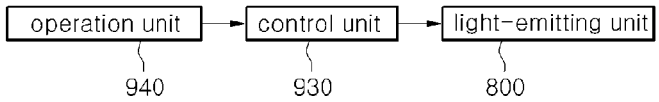
FIG. 6 is a block diagram showing a control structure of the refrigerator according to a second embodiment.

FIG. 6 shows a control structure of the refrigerator according to a second embodiment in a block diagram.

The present embodiment is almost the same as the first embodiment, except that the operation of the light-emitting unit is selected by the users. Hereinafter, characteristic parts of the present embodiment will be explained.

Referring to FIG. 6, the refrigerator of the present embodiment includes a light-emitting unit 800, an operation unit 940 for selecting whether the light-emitting unit 800 operates or not, and a control unit 930 for controlling at least the operation of the light-emitting unit 800 in accordance with the signal inputted through the operation unit 940.

In detail, in case the "ON" signal of the light-emitting unit 800 is inputted through the operation unit 940, the light-emitting unit 800 is operated by the control unit 930. And, in case the "OFF" signal of the light-emitting unit 800 is inputted through the operation unit 940, the light-emitting unit 800 is turned-off by the control unit 930.

Unlike these cases, the period of the ON state of the light-emitting unit 800 reaches a certain period of time without the operation of the operation unit 940, the light-emitting unit 800 may be turned-off.

Figure 7:
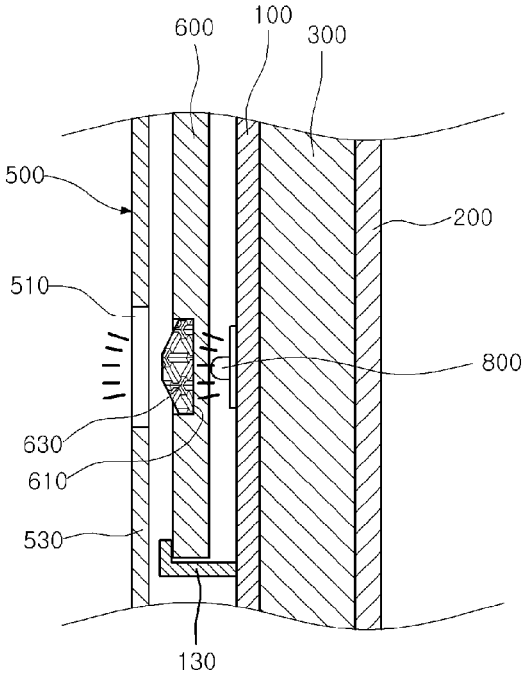
FIG. 7 is a cross-section view of a refrigerator door according to a third embodiment.

FIG. 7 shows a refrigerator door according to a third embodiment in a cross-section view.

The present embodiment is almost the same as the first embodiment, except for a structure of mounting the light-emitting unit. Hereinafter, characteristic parts of the present embodiment will be explained.

Referring to FIG. 7, the light-emitting unit 800 is mounted on the outer case 100. The light-emitting unit may be spaced apart from the transparent plate 600 or be closely contacted therewith, in a state where it is mounted on the outer case.

Figure 8:
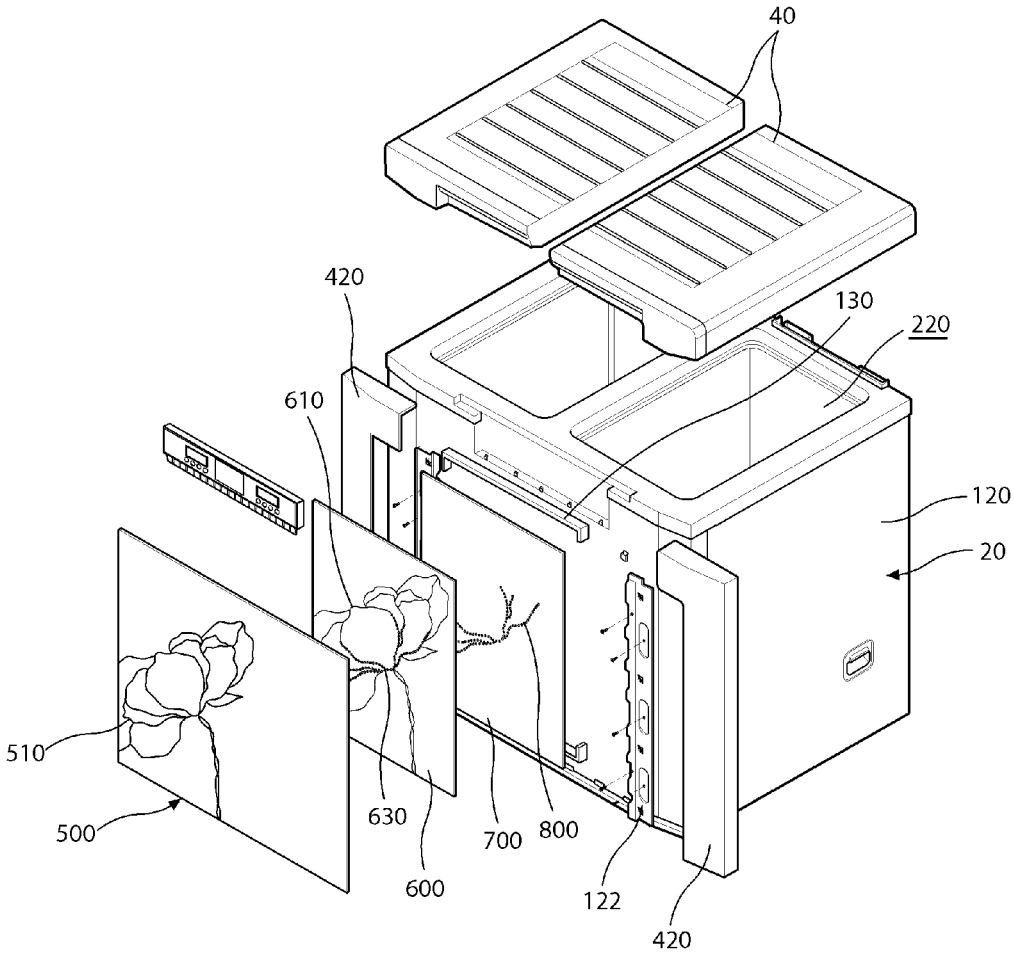
FIG. 8 is an exploded perspective view of a refrigerator according to a fourth embodiment.

FIG. 8 a refrigerator according to a fourth embodiment in an exploded perspective view.

The present embodiment is almost the same as the first embodiment, except for locations where the exterior member and light-emitting unit are mounted. Hereinafter, characteristic parts of the present embodiment will be explained. Further, since structures of the light-emitting unit, transparent plate and exterior member are the same as those of the first embodiment, the same reference numerals will be used.

Referring to FIG. 8, the refrigerator according to the present embodiment includes a main body 20 in which a storage chamber is formed, and a door 40 which opens or closes the storage chamber as it is connected to an upper portion of the main body 20.

The main body 20 includes an outer case 120 and an inner case 220. An exterior member 500 is provided at an outer side of the outer case 120. The exterior member 500 defines a front appearance of the main body 20, and it is fixed by a decorative part 420 and a mounting bracket 122.

And, the transparent plate 600 is provided at a rear side of the exterior member 500, and the fixed plate 700 in which the light-emitting unit 800 is installed is located at a rear side of the transparent plate 600.

That is, according to the present embodiment, the light-emitting unit 800 is not provided at the door 40, but is provided at the outside of the main body 20.

The invention claimed is:

1. A refrigerator having a refrigerator main body in which a storage chamber is formed, and a door which opens or closes the storage chamber, the door comprising:

an exterior member comprising a plurality of transmissive portions, and a non-transmissive portion;

a light-emitting unit disposed between the exterior member and the storage chamber, the light-emitting unit configured to emit light, wherein at least some of the light emitted therefrom passes through the plurality of transmissive portions;

a transparent plate provided between the exterior member and the light-emitting unit; and a plurality of decoration members installed on the transparent plate, wherein the plurality of transmissive portions and the plurality of decoration members define a specific pattern, wherein an appearance of the door is defined by transmitting the emitted light through the specific pattern, and wherein at least one of the plurality of transmissive portions, at least one of the plurality of decoration members and a portion of light-emitting unit are arranged to have a same shape.

2. The refrigerator according to claim 1, wherein at least some of the light emitted from the light-emitting unit passes through the plurality of decoration members.

3. The refrigerator according to claim 1, wherein the plurality of transmissive portions are transparently or semi-transparently formed.

4. The refrigerator according to claim 1, wherein the light emitting unit emits light from a rear side of the transparent plate to the plurality of decoration members.

5. The refrigerator according to claim 1, further comprising:

a fixed plate on which the light-emitting unit is mounted, wherein the fixed plate is connected to the transparent plate.

6. The refrigerator according to claim 1, wherein the light-emitting unit includes at least one LED.

7. The refrigerator according to claim 1, wherein at least one of the plurality of transmissive portions, at least one of the plurality of decoration members and a portion of the light-emitting unit are arranged in a row.

8. The refrigerator according to claim 1, wherein the exterior member defines the appearance of the refrigerator main body.

9. The refrigerator according to claim 1, wherein the exterior member defines the appearance of the door.

10. The refrigerator according to claim 1, further comprising:

a sensor unit for detecting an intensity of illumination, wherein in case the intensity of illumination detected by the sensor unit is lower than a specific level, the light-emitting unit is turned on.

11. The refrigerator according to claim 1, further comprising:

an operation unit for inputting ON or OFF signal of the light-emitting unit.

12. The refrigerator according to claim 1, wherein the shape of the specific pattern that forms the appearance of the refrigerator door is the same as the shape of an arrangement of the plurality of decorative members installed on the transparent plate.

13. A refrigerator having a main body in which a storage chamber is formed, and a door which opens or closes the storage chamber, the door comprises:

a door main body;

an exterior member provided at a front side of the door main body, the exterior member comprising a plurality of transmissive portions, and a non-transmissive portion;

a plurality of decoration members provided at a rear side of the transmissive portions of the exterior member; and a light-emitting unit provided at a rear side of the decoration member, the light-emitting unit configured to emit light such that the decoration member and the plurality of transmissive portions define a specific pattern, and the specific pattern is illuminated to form an appearance of the door, wherein at least one of the plurality of transmissive portions, at least one of the plurality of decoration members and a portion of the light-emitting unit are arranged in a row.

14. The refrigerator according to claim 13, wherein a transparent plate through which the light emitted from the light-emitting unit is passed is provided at the rear side of the exterior member, and wherein the decoration member is mounted on the transparent plate.

15. The refrigerator according to claim 14, further comprising:

a fixed plate on which the light-emitting unit is mounted, wherein the fixed plate is connected to the transparent plate.

16. The refrigerator according to claim 13, wherein the light-emitting unit is installed at the door main body.

17. The refrigerator according to claim 13, wherein the light emitted from the light-emitting unit passes through the exterior member after passing through the decoration member.

18. The refrigerator according to claim 13, wherein the light emitting unit is included in a plurality of light emitting units, wherein the plurality of transmissive portions, the plurality of the decoration members, and the plurality of light emitting units are arranged in a plurality of row structures, and wherein the shape of the specific pattern that forms the appearance of the refrigerator door is the same as the shape of an arrangement of the plurality of row structures.

19. A refrigerator door, comprising:

an exterior member having a plurality of transmissive portions and a non-transmissive portion;

a plate disposed at a rear side of the exterior member;

a light-emitting unit installed on a front side of the plate and configured to emit light;

a supporter disposed between the rear side of the exterior member and the front side of the plate;

a plurality of decoration members installed on the supporter; and a mounting portion disposed at the rear side of the exterior member, wherein the plate is coupled to the supporter and the plate and the supporter are mounted on the mounting portion, and wherein the plurality of transmissive portions and the plurality of decoration members define a specific pattern;

wherein at least one of the plurality of transmissive portions, a portion of the decoration member and a portion of light-emitting unit are arranged in a row.

20. The refrigerator door according to claim 19, wherein the specific pattern is illuminated by the emitted light to form an appearance of the refrigerator door.

* * * * *